US007357703B2

(12) United States Patent
Nishimura et al.

(10) Patent No.: US 7,357,703 B2
(45) Date of Patent: Apr. 15, 2008

(54) CHEMICAL MECHANICAL POLISHING PAD AND CHEMICAL MECHANICAL POLISHING METHOD

(75) Inventors: Hideki Nishimura, Chuo-ku (JP); Takafumi Shimizu, Chuo-ku (JP); Keisuke Kuriyama, Chuo-ku (JP); Shoei Tsuji, Chuo-ku (JP)

(73) Assignee: JSR Corporation, Tokyo (JP)

( * ) Notice: Subject to any disclaimer, the term of this patent is extended or adjusted under 35 U.S.C. 154(b) by 0 days.

(21) Appl. No.: 11/616,570

(22) Filed: Dec. 27, 2006

(65) Prior Publication Data

US 2007/0149096 A1 Jun. 28, 2007

(30) Foreign Application Priority Data

Dec. 28, 2005 (JP) ..... 2005-377148

(51) Int. Cl.
*B24D 11/00* (2006.01)

(52) U.S. Cl. ..... 451/527; 451/526

(58) Field of Classification Search ..... 451/41, 451/526–539

See application file for complete search history.

(56) References Cited

U.S. PATENT DOCUMENTS

| | | | | |
|---|---|---|---|---|
| 5,921,855 | A | 7/1999 | Osterheld et al. | |
| 5,984,769 | A | 11/1999 | Bennett et al. | |
| 6,089,966 | A * | 7/2000 | Arai et al. | 451/533 |
| 6,120,366 | A * | 9/2000 | Lin et al. | 451/550 |
| 6,729,950 | B2 * | 5/2004 | Park et al. | 451/528 |
| 6,749,714 | B1 * | 6/2004 | Ishikawa et al. | 156/345.12 |
| 2005/0260929 | A1 | 11/2005 | Hosaka et al. | |
| 2007/0082587 | A1 | 4/2007 | Hosaka et al. | |

FOREIGN PATENT DOCUMENTS

| | | |
|---|---|---|
| JP | 8-500622 | 1/1996 |
| JP | 8-216029 | 8/1996 |
| JP | 11-70463 | 3/1999 |
| JP | 2000-34416 | 2/2000 |
| JP | 2004-507077 | 3/2004 |
| WO | WO 94/04599 | 3/1994 |
| WO | WO 01/91972 A1 | 12/2001 |

* cited by examiner

*Primary Examiner*—Dung Van Nguyen
(74) *Attorney, Agent, or Firm*—Oblon, Spivak, McClelland, Maier & Neustadt, P.C.

(57) ABSTRACT

A chemical mechanical polishing pad of the present invention has the following two groups of grooves on the polishing surface: (i) a group of first grooves intersect a single virtual straight line extending from the center toward the periphery of the polishing surface and have a land ratio represented by the following equation of 6 to 30: Land ratio=(P−W)÷W (where P is the distance between adjacent intersections between the virtual straight line and the first grooves, and W is the width of the first grooves); and (ii) a group of second grooves extend from the center portion toward the peripheral portion of the polishing surface and consist of second grooves which are in contact with one another in the area of the center portion and second grooves which are not in contact with any other second grooves in the areas of the center portion. The chemical mechanical polishing pad of the present invention has a high polishing rate and excellent in-plane uniformity in the amount of polishing of the surface to be polished even when the amount of an aqueous dispersion for chemical mechanical polishing is made small.

22 Claims, 3 Drawing Sheets

CHEMICAL MECHANICAL POLISHING PAD AND CHEMICAL MECHANICAL POLISHING METHOD

FIELD OF THE INVENTION

The present invention relates to a chemical mechanical polishing pad and a chemical mechanical polishing method.

DESCRIPTION OF THE PRIOR ART

In the manufacture of a semiconductor device, chemical mechanical polishing (generally abbreviated as CMP) is now often used as a polishing technique capable of forming an extremely flat surface for a silicon substrate or a silicon substrate having wirings and electrodes thereon. Chemical mechanical polishing is a technique for polishing by letting an aqueous dispersion for chemical mechanical polishing (aqueous dispersion containing abrasive grains dispersed therein) flow down over the surface of a chemical mechanical polishing pad while the polishing pad and the surface to be polished are brought into slide contact with each other. It is known that the polishing result is greatly affected by the shape and properties of the chemical mechanical polishing pad in this chemical mechanical polishing. A wide variety of chemical mechanical polishing pads have been proposed up till now.

For example, JP-A 8-500622 and JP-A 2000-34416 investigate materials constituting the chemical mechanical polishing pad. It is known that the polishing rate and the surface state of the polished product can be improved by forming grooves in the surface (polishing surface) of the chemical mechanical polishing pad, and many studies have been made on the design of grooves (refer to JP-A 11-70463, JP-A 8-216029 and JP-A 2004-507077, for example).

Out of these, JP-A 2004-507077 makes a detailed investigation into the relationship between the density of grooves in the polishing surface and polishing efficiency. According to this publication, concentrically circular grooves serve to trap an aqueous dispersion for chemical mechanical polishing which is introduced into the center of the pad at the time of polishing and moved toward the periphery of the pad by centrifugal force, and the appropriate value of the density of grooves depends on the characteristic properties of the material constituting the surface to be polished and the size of the pad. That is, when an oxide insulating material or tungsten in which a mechanical factor is predominant is used as the object to be polished in chemical mechanical polishing, the density of grooves is preferably low and when copper or aluminum in which a chemical factor is predominant is used as the object to be polished, the density of grooves is preferably high. A larger pad preferably has a higher density of grooves. Meanwhile, it is acknowledged in the above publication that the amount of polishing of the surface to be polished becomes nonuniform only when the density of grooves is made uniform over the entire surface of the pad. It is proposed that the density of grooves in an area of the polishing surface of the pad corresponding to the tracks of a portion where a higher polishing rate is desired of the surface to be polished should be made lower than that in the other area so as to make uniform the entire polishing rate for the surface to be polished. This shows that there is a trade-off relationship between a demand for the improvement of the supply of the aqueous dispersion for chemical mechanical polishing to the interface between the surface to be polished and the polishing surface of the pad (a demand for increasing the density of grooves) and a demand for the improvement of the contact area between the surface to be polished and the polishing surface of the pad (a demand for reducing the density of grooves).

JP-A 11-70463 proposes that the width, pitch, depth or shape (circular grooves and meandering grooves) of grooves should be changed for each area of the polishing surface of the polishing pad to improve the polishing uniformity of the surface to be polished. The above publication is also aimed to balance between the supply of the aqueous dispersion to the interface between the polishing surface and the surface to be polished and the contact area between the polishing surface and the surface to be polished. However, the above publication presents some groove design ideas conceivable from the above concept and does not give any specific guide to find which groove pattern is actually useful in the real production scene.

Meanwhile, in the current situation where the cost competition of semiconductor products is becoming keener and keener, the reduction of the amount of the aqueous dispersion for chemical mechanical polishing to be supplied for chemical mechanical polishing is one of the effective means of cutting costs. However, there is unknown a prior art which investigates the design of grooves so as to supply the aqueous dispersion to the entire surface of the polishing surface of the pad efficiently and achieve a high polishing rate and the high uniformity of the polished surface even when the amount of the aqueous dispersion for chemical mechanical polishing is made small.

SUMMARY OF THE INVENTION

It is an object of the present invention which has been made in view of the above situation to provide a chemical mechanical polishing pad which has a high polishing rate and excellent in-plane uniformity in the amount of polishing of the surface to be polished even when the amount of an aqueous dispersion for chemical mechanical polishing is made small as well as a chemical mechanical polishing method.

According to the present invention, firstly, the above object of the present invention is attained by a chemical mechanical polishing pad having a polishing surface and a non-polishing surface on the opposite side, wherein the polishing surface has at least two groups of grooves;

(i) a group of first grooves intersect a single virtual straight line extending from the center toward the periphery of the polishing surface, do not intersect one another and have a land ratio represented by the following equation (1) of 6 to 30:

$$\text{Land ratio}=(P-W)\div W \quad (1)$$

(P is the distance between adjacent intersections between the virtual straight line and the first grooves, and W is the width of the first grooves); and (ii) a group of second grooves extend from the center portion toward the peripheral portion of the polishing surface, intersect the first grooves, consist of second grooves which are in contact with one another in the area of the center portion and second grooves which are not in contact with any other second grooves in the area of the center portion, and do not intersect one another.

Secondly, the above object of the present invention is attained by a chemical mechanical polishing pad having a polishing surface and a non-polishing surface on the opposite side, wherein the polishing surface has one first groove and a group of second grooves:

(i) the first groove is one spiral groove which expands gradually from the center portion toward the peripheral portion of the polishing surface and has a land ratio represented by the following equation (2) of 6 to 30:

$$\text{Land ratio}=(P'-W')\div W' \quad (2)$$

(P' is the distance between adjacent intersections between a single virtual straight line extending from the center toward the periphery of the polishing pad and the first groove, and W' is the width of the first groove); and (ii) the group of second grooves extend from the center portion toward the peripheral portion of the polishing surface, intersect the first groove, consist of second grooves which are in contact with one another in the area of the center portion and second grooves which are not in contact with any other second grooves in the area of the center portion, and do not intersect one another.

Thirdly, the above object of the present invention is attained by a method of chemically mechanically polishing an object to be polished by using any one of the above chemical mechanical polishing pads.

According to the present invention, there are provided a chemical mechanical polishing pad which has a high polishing rate and excellent in-plane uniformity in the amount of polishing of the surface to be polished even when the amount of an aqueous dispersion for chemical mechanical polishing is made small and a chemical mechanical polishing method using the polishing pad.

EXPLANATION OF REFERENCE NUMERALS

Figure 1:
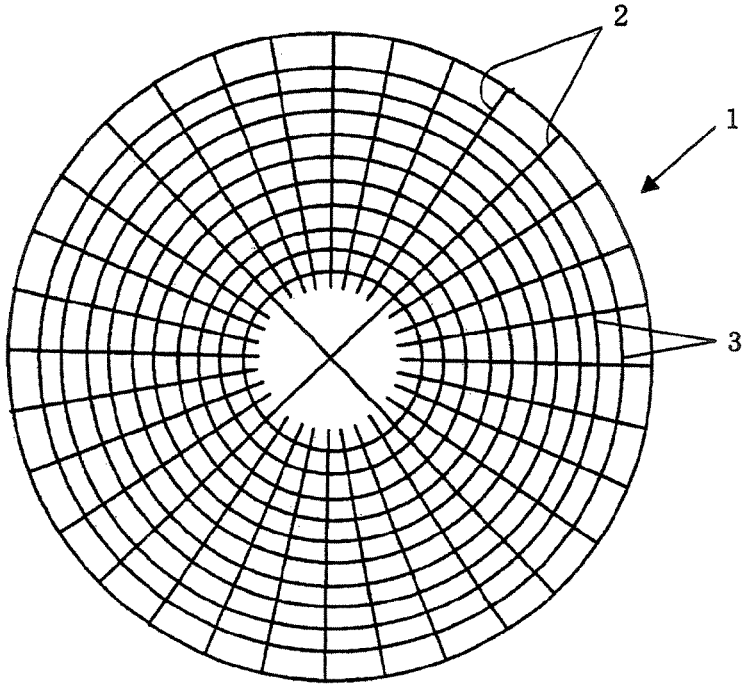
FIG. 1 is a schematic diagram showing an example of the configuration of the grooves of the chemical mechanical polishing pad of the present invention.

1: chemical mechanical polishing pad
2: second groove
3: first groove

BEST MODE FOR THE EMBODIMENTS OF THE INVENTION

The first chemical mechanical polishing pad (may be referred to as "first polishing pad" hereinafter) of the present invention has a polishing surface and a non-polishing surface on the opposite side, wherein the above polishing surface has at least two groups of grooves:

(i) a group of first grooves intersect a single virtual straight light extending from the center toward the periphery of the polishing surface, do not intersect one another and have a land ratio represented by the following equation (1) of 6 to 30:

$$\text{Land ratio}=(P-W)\div W \quad (1)$$

(P is the distance between adjacent intersections between the virtual straight line and the first grooves, and W is the width of the first grooves); and (ii) a group of second grooves extend from the center portion toward the peripheral portion of the polishing surface, intersect the first grooves, consist of second grooves which are in contact with one another in the area of the center portion and second grooves which are not in contact with any other second grooves in the area of the center portion, and do not intersect one another.

Although the first grooves formed in the polishing surface are not limited to a particular shape, they may be, for example, two or more spiral grooves which expand gradually from the center portion toward the peripheral portion of the polishing surface, or a plurality of annular or polygonal grooves which do not intersect one another and are arranged concentrically or eccentrically. The annular grooves may be circular or elliptic, and the polygonal grooves may be tetragonal, pentagonal, etc.

The first grooves do not intersect one another.

The first grooves are formed in the polishing surface in such a manner that they intersect a single virtual straight line extending from the center portion toward the peripheral portion of the polishing surface a plurality of times. For example, when the grooves are annular and the number of the annular grooves is 2, the number of intersections is 2, when the number of the annular grooves is 3, the number of intersections is 3, and when the number of the annular grooves is "n", the number of intersections is "n". When the grooves are polygonal, the same can be said. When there are two spiral grooves, based on the condition that one turn is 360°, the number of intersections is 2 before the second turn, 3 after the start of the second turn, (2n-2) before the "n"-th turn and (2n-1) after the start of the "n"-th turn.

When the first grooves are annular or polygonal, they are arranged not to intersect one another and may be arranged concentrically or eccentrically but preferably concentrically. A polishing pad having grooves which are arranged concentrically is superior in the above functions to other polishing pads. The annular grooves are preferably circular grooves, more preferably circular grooves concentric with one another. When the circular grooves are concentric with one another, they are much superior in the above functions and easily formed.

The sectional form in the width direction, that is, the normal direction of the grooves is not particularly limited. It may be, for example, polygonal with three or more sides including flat sides and a bottom side, U-shaped or V-shaped. The polygonal grooves may be such as tetragonal, pentagonal.

The first grooves have a land ratio represented by the following equation (1) of 6 to 30.

$$\text{Land ratio}=(P-W)\div W \quad (1)$$

(P is the distance between adjacent intersections between the above virtual straight line and the first grooves (may be referred to as "pitch" hereinafter), and W is the width of the first grooves)

The land ratio represented by the above equation (1) is preferably 6 to 20, more preferably 6 to 15.

The width (W) of the first grooves is preferably 0.1 mm or more, more preferably 0.1 to 5.0 mm, much more preferably 0.1 to 1.0 mm, particularly preferably 0.1 to 0.375 mm, ideally 0.1 to 0.35 mm. When the width (W) of the first grooves is 0.375 mm or less, particularly 0.35 mm or less, the effect of the present invention is exhibited most effectively. The pitch (P) of the first grooves is preferably 0.6 mm or more, more preferably 1.0 to 30 mm, much more preferably 1.5 to 10 mm, particularly preferably 3.8 to 10 mm. When the pitch of the first grooves is 3.8 mm or more, the effect of the present invention is exhibited most effectively. The depth of the first grooves is preferably 0.1 mm or more, more preferably 0.1 to 2.5 mm, much more preferably 0.2 to 2.0 mm. Due to the above first grooves, there can be easily manufactured a chemical mechanical polishing pad which has a high polishing rate and excellent in-plane uniformity in the amount of polishing of the surface to be polished even when the amount of the aqueous dispersion for chemical mechanical polishing is made small.

The surface roughness (Ra) of the inner wall of each of the first grooves is preferably 20 μm or less, more preferably 0.05 to 15 μm, much more preferably 0.05 to 10 μm. A scratch which may be produced on the polished surface in the chemical mechanical polishing step can be prevented more effectively by setting this surface roughness to 20 μm or less.

The above surface roughness (Ra) is defined by the following equation (3):

$$Ra=\Sigma|Z-Z_{av}|/N \quad (3)$$

(N is the number of measurement points, Z is the height of a roughness profile, and $Z_{av}$ is the average height of the roughness profile)

The above second grooves consist of a plurality of grooves extending from the center portion toward the peripheral portion of the polishing surface. The expression "center portion" as used herein means an area surrounded by a circle having a radius of 50 mm from the center of gravity on the surface of the chemical mechanical polishing pad as the center thereof. The second grooves may extend from any point within this "center portion" toward the peripheral portion and may be linear, arcuate or a combination thereof.

The second grooves may or may not reach the peripheral end. Preferably, at least one of them reaches the peripheral end. For example, the second grooves may consist of a plurality of linear grooves extending from the center portion toward the peripheral portion and at least one of them may reach the side surface of the pad, or the second grooves may consist of a plurality of linear grooves extending from the center portion toward the peripheral portion and a plurality of linear grooves extending from a halfway portion between the center portion and the peripheral portion toward the peripheral portion and at least one of them may reach the peripheral end of the pad. Further, the second grooves may consist of pairs of parallel linear grooves.

The second grooves consist of second grooves which are in contact with one another in the area of the center portion and second grooves which are not in contact with any other second grooves in the area of the center portion. The second grooves which are not in contact with any other second grooves in the area of the center portion are existent between adjacent second grooves which are in contact with one another in the area of the center portion. The second grooves do not intersect one another even when they are in contact with other second grooves.

Preferably, the total number of the second grooves is 6 to 96, the number of the second grooves which are in contact with one another is 2 to 32, and the number of the second grooves which not in contact with any other second grooves is 4 to 64. More preferably, the total number of the second grooves is 6 to 48, the number of the second grooves which are in contact with one another is 2 to 16, and the number of the second grooves which are not in contact with any other second grooves is 4 to 32. Most preferably, the total number of the second grooves is 6 to 36, the number of the second grooves which are in contact with one another is 2 to 4, and the number of the second grooves which are not in contact with any other second grooves is 4 to 32.

Out of the second grooves, the number of the second grooves which are not in contact with any other second grooves in the area of the center portion is preferably larger than the number of the second grooves which are in contact with one another in the area of the center portion. The same number of second grooves which are not in contact with any other second grooves are preferably existent between every adjacent pair of the second grooves which are in contact with one another.

When all the second grooves extend from the center portion toward the peripheral portion, the second grooves which are not in contact with any other second grooves in the area of the center portion preferably start from positions 10 to 50 mm away from the center of the pad and extend toward the peripheral portion from there, more preferably start from positions 20 to 50 mm from the center of the pad and extend toward the peripheral portion from there The second grooves which are in contact with one another in the area of the center portion preferably start from the center of the pad and extend toward the peripheral portion.

Meanwhile, when the second grooves consist of a plurality of linear grooves extending from the center portion toward the peripheral portion and a plurality of linear grooves extending from a halfway portion between the center portion and the peripheral portion, the grooves which start from a halfway portion between the center portion and the peripheral portion start from points which are existent on a virtual straight line connecting the center and the periphery of the pad and preferably 20 to 80% of the distance from the center to the periphery of the pad, more preferably 40 to 60% of the distance from the center to the periphery of the pad. Also in this case, the plurality of linear grooves extending from the center portion toward the peripheral portion consist of second grooves which are not in contact with any other second grooves in the area of the center portion and second grooves which are in contact with one another in the area of the center portion. The preferred configuration of the second grooves starting from the center portion is the same as the configuration of second grooves all of which extend from the center portion toward the peripheral portion.

The width of the second grooves is preferably 0.1 to 5.0 mm, more preferably 0.1 to 4.0 mm, much more preferably 0.2 to 3.0 mm. The depth of the second grooves is the same as the depth of the first grooves. The preferred range of the surface roughness (Ra) of the inner wall of each of the second grooves is the same as that of the above surface roughness (Ra) of the inner wall of each of the first grooves.

The second grooves are preferably spaced apart from one another as equally as possible on the surface of the chemical mechanical polishing pad.

The second chemical mechanical polishing pad of the present invention (may be referred to as "second polishing pad" hereinafter) has a single spiral groove which expands gradually from the center portion toward the peripheral portion of the polishing surface in place of the first grooves of the above first polishing pad.

The number of turns of the first spiral groove may be 20 to 400, preferably 20 to 300, more preferably 20 to 200. 360° corresponds to one turn.

The first groove of the second polishing pad has a land ratio represented by the following equation (2) of 6 to 30.

$$\text{Land ratio}=(P'-W')\div W \quad (2)$$

(P' is the distance between adjacent intersections between a single virtual straight line extending from the center toward the periphery of the polishing surface and the first groove (may be referred to as "pitch" hereinafter), and W' is the width of the first groove.)

The land ratio represented by the above equation (2) is preferably 6 to 20, more preferably 6 to 15.

The width W', pitch P' and depth of the first grooves of the second polishing pad are the same as the width W, pitch P and depth of the first grooves of the above first polishing pad. The preferred range of the surface roughness (Ra) of the inner wall of the first groove of the second polishing pad is the same as that of the surface roughness (Ra) of the inner wall of each of the first grooves of the above first polishing pad. As for what is not described of the second polishing pad, it should be understood that what has been described of the first polishing pad can be applied to the second polishing pad directly or with modifications obvious to a person having ordinary skill in the art.

The chemical mechanical polishing pad of the present invention has the above specific grooves on the polishing surface and may have a groove, grooves or other recessed portion having a desired shape on the non-polishing surface. When the chemical mechanical polishing pad has such a groove, grooves or other recessed portion, the surface state of the polished surface can be further improved. As for the shape of the grooves on the non-polishing surface, they may include a plurality of concentrically circular grooves, a plurality of concentrically elliptic grooves, a plurality of polygonal grooves with the same center of gravity, two or more spiral grooves, a plurality of grooves extending from the center portion toward the peripheral portion of the pad, or a plurality of linear grooves forming a triangle lattice, square lattice or hexagonal lattice. As for the shape of the groove on the non-polishing pad, it may be, for example, one spiral groove. As for the shape of the other recessed portion on the non-polishing surface, it consists of a circle and the inside surrounded by the circle, or a polygon and the inside surrounded by the polygon.

The groove, grooves or other recessed portion on the non-polishing surface preferably does not reach the peripheral end of the pad.

The chemical mechanical polishing pad preferably has a recessed portion consisting of a circle and the inside surrounded by the circle, or a polygon and the inside surrounded by the polygon at the center of the non-polishing surface. The expression "at the center" is a concept including a case where the center of gravity of the recessed portion matches the center of gravity of the non-polishing surface in a mathematically strict sense and also a case where the center of gravity of the non-polishing surface of the pad is located within the area of the above recessed portion.

The shape of the chemical mechanical polishing pad of the present invention is not particularly limited but may be disk-like or polygonal column-like. It may be suitably selected according to the polishing machine which is used in combination with the chemical mechanical polishing pad of the present invention.

For example, when the chemical mechanical polishing pad of the present invention has a disk-like shape, the opposite circular top surface and circular bottom surface become the polishing surface and the non-polishing surface, respectively.

The size of the chemical mechanical polishing pad is not particularly limited. For example, a disk-like chemical mechanical polishing pad has a diameter of 150 to 1,200 mm, particularly preferably 500 to 800 mm and a thickness of 0.5 to 5.0 mm, preferably 1.0 to 3.0 mm, particularly preferably 1.5 to 3.0 mm.

The chemical mechanical polishing pad of the present invention may have a light transmitting area which optically communicates from the polishing surface to the non-polishing surface. When the pad having such a light transmitting area is set in a chemical mechanical polishing machine having an optical polishing end-point detector, the polishing end point can be detected optically. The plane shape of the light transmitting area is not particularly limited and may be circular, elliptic, fan-shaped or polygonal (square or rectangular). The position of the light transmitting area should be a position corresponding to the position of the optical polishing end-point detector of the chemical mechanical polishing machine having the chemical mechanical polishing pad of the present invention. The number of light transmitting areas may be one or more. When more than one light transmitting area is formed, their positions are not particularly limited if they satisfy the above position relationship.

Any method may be employed to form the light transmitting area. For example, the area having light transmitting properties of the pad is composed of a light transmitting member. When the pad is made of a material having a certain level of light transmission, a recessed portion is formed at a position corresponding to the area which should have light transmission properties of the non-polishing surface of the pad and the area is made thin to ensure light transmission properties required for the detection of the polishing end point. In the latter method, the light transmitting area can serve as the recessed portion for improving the above surface state of the polished surface.

Examples of the configuration of the grooves of the above chemical mechanical polishing pad will be described with reference to the accompanying drawings.

In FIGS. 1 to 5, the number of the first grooves is about 10. These figures are schematic and it should be understood that the number of the first grooves calculated from the diameter of the polishing surface of the pad and the above pitch is preferred. FIGS. 1 to 5 show examples of the first polishing pad and it should be understood that these figures also show examples of the second polishing pad in which the first grooves of the illustrated first polishing pad are replaced by a single spiral groove.

In FIG. 1, the pad 1 has second grooves which are 32 linear grooves 2 and first grooves which are 10 concentrically circular grooves 3 different from one another in diameter. 4 out of the 32 linear grooves start from the center and are in contact with one another whereas the other 28 linear grooves start from a portion slightly away from the center toward the periphery (it can be judged from the fact the these linear grooves intersect the smallest circular groove out of the first grooves that this portion is the center portion) and are not in contact with any other second grooves. In the pad of FIG. 1, 7 second grooves which are not in contact with any other second grooves in the area of the center portion are existent between every adjacent pair of the 4 second grooves which are in contact with one another in the area of the center portion. All of the 32 linear grooves of the pad of FIG. 1 reach the peripheral end of the pad.

Figure 2:
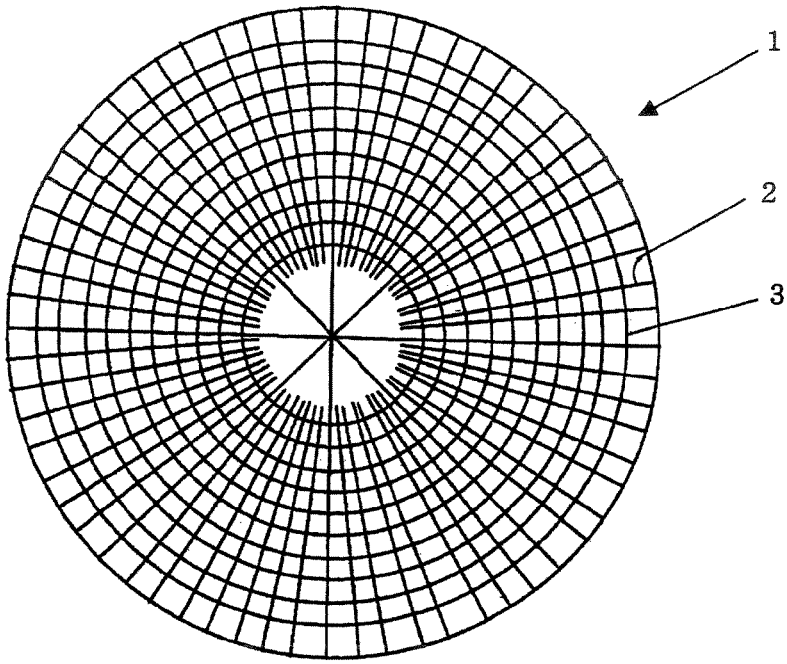
FIG. 2 is a schematic diagram showing another example of the configuration of the grooves of the chemical mechanical polishing pad of the present invention.

In FIG. 2, the pad 1 has second grooves which are 64 linear grooves 2 and first grooves which are 10 concentrically circular grooves 3 different from one another in diameter. 8 out of the 64 linear grooves start from the center and are in contact with one another whereas the other 56 linear grooves start from a portion slightly away from the center toward the periphery and are not in contact with any other second grooves. In the pad of FIG. 2, 7 second grooves which are not in contact with any other second grooves in the area of the center portion are existent between every adjacent pair of the 8 second grooves which are in contact with one another in the area of the center portion. All of the 64 linear grooves of the pad of FIG. 2 reach the peripheral end of the pad.

Figure 3:
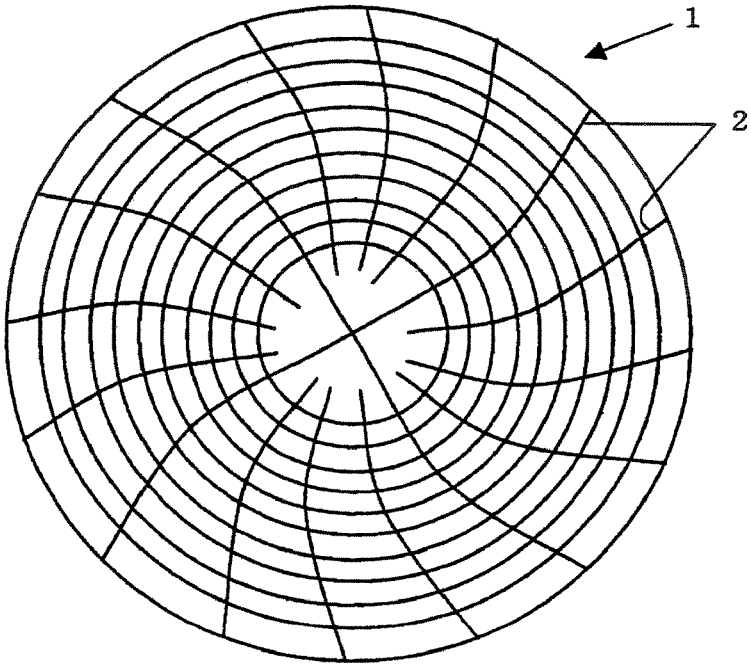
FIG. 3 is a schematic diagram showing still another example of the configuration of the grooves of the chemical mechanical polishing pad of the present invention.

In FIG. 3, the pad 1 has 16 second grooves 2 which extend from the center portion toward the peripheral portion. 4 out of the 16 grooves start from the center and are in contact with one another whereas the other 12 grooves start from a portion slightly away from the center toward the periphery and are not in contact with any other second grooves. The 16 grooves curve to the left halfway from the center toward the periphery as shown in the figure but extend almost linearly excluding the curved portion. In the pad of FIG. 3, 3 second grooves which are not in contact with any other second grooves in the area of the center portion are existent between every adjacent pair of the 4 second grooves which are in contact with one another in the area of the center portion. In the pad of FIG. 3, all of the 16 linear grooves reach the peripheral end of the pad as well.

Figure 4:
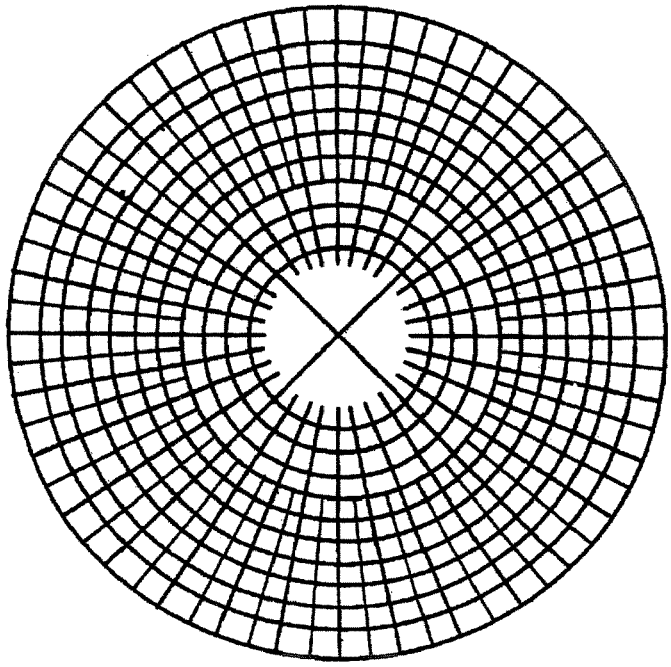
FIG. 4 is a schematic diagram showing a further example of the configuration of the grooves of the chemical mechanical polishing pad of the present invention.

In FIG. 4, the pad has 32 linear grooves starting from a halfway portion between the center portion and the peripheral portion, each one of which is existent between every adjacent pair of the 32 linear grooves in FIG. 1. All of the 32 linear grooves start from the fourth concentrically circular groove from the center in the figure.

Figure 5:
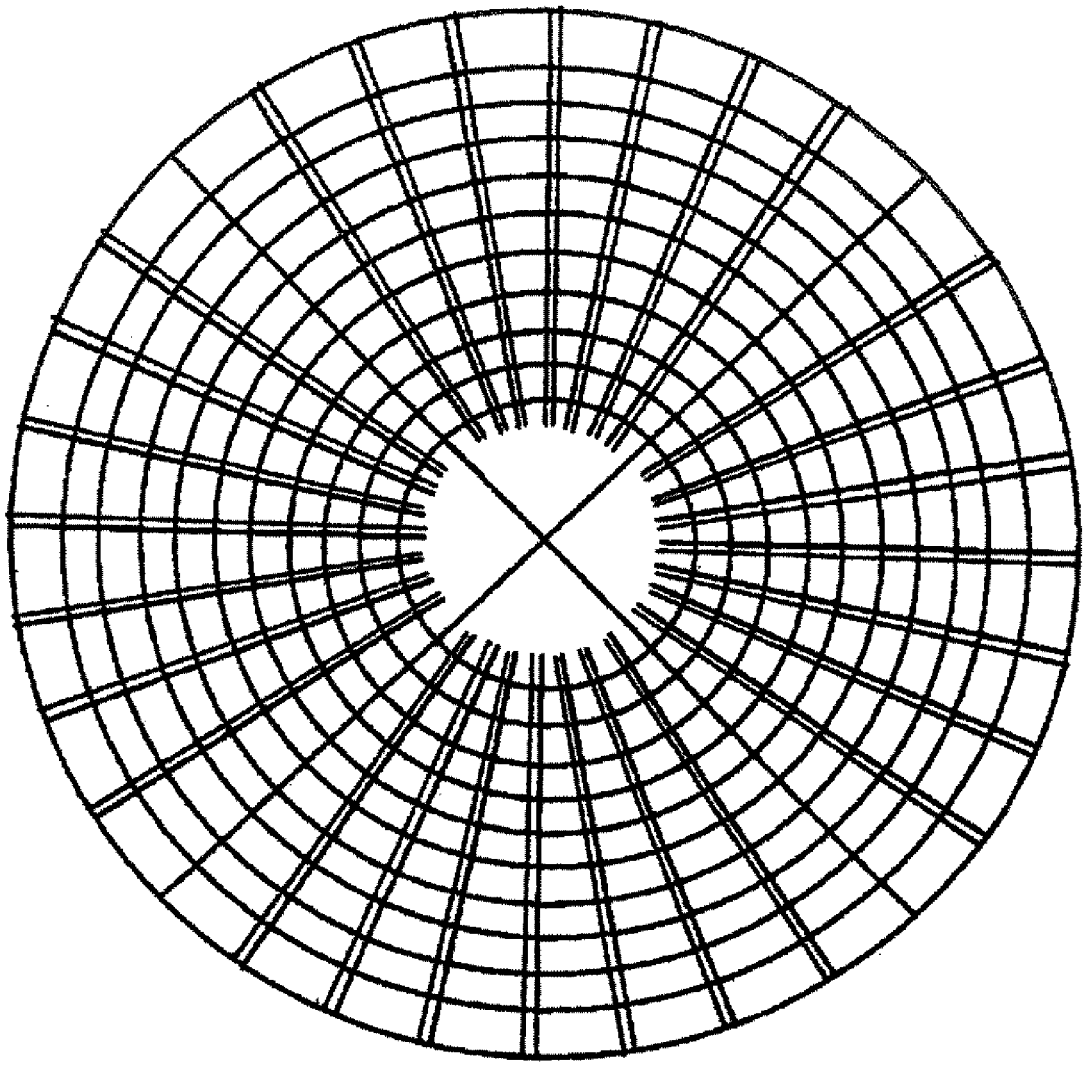
FIG. 5 is a schematic diagram showing a still further example of the configuration of the grooves of the chemical mechanical polishing pad of the present invention.

In FIG. 5, the pad has 28 linear grooves in FIG. 1 which start from a portion slightly away from the center toward the periphery, each consisting of a pair of parallel linear grooves.

The chemical mechanical polishing pad of the present invention may be made of any material if it has the above requirements and can serve as a chemical mechanical polishing pad. It is particularly preferred that pores having the function of holding slurry during chemical mechanical polishing and the function of retaining substances which are generated by polishing and of the surface to be polished temporarily out of the functions of the chemical mechanical polishing pad should be formed by the time of polishing. Therefore, the polishing pad preferably comprises a material containing a water-insoluble matrix and water-soluble particles dispersed in the water-insoluble matrix, or a material containing a water-insoluble matrix and voids dispersed in the water-insoluble matrix (for example, foam).

In the former material out of these, the water-soluble particles dissolve or swell upon their contact with an aqueous medium contained in the aqueous dispersion for chemical mechanical polishing at the time of polishing to be eliminated, and slurry can be held in pores formed by the elimination. In the latter material, the slurry can be held in pores formed as the voids in advance.

In the former material, the material constituting the above water-insoluble matrix is not particularly limited but an organic material is preferably used because it can be easily molded into a predetermined shape and can easily provide desired properties such as suitable hardness and suitable elasticity. Examples of the organic material include thermoplastic resins, elastomers, rubbers and cured resins (resins obtained by curing thermally or optically curable resins by heat or light). They may be used alone or in combination.

Out of these, the thermoplastic resins include 1,2-polybutadiene resin, polyolefin resins, polystyrene resins, polyacrylic resins, vinyl ester resins (excluding polyacrylic resins), polyester resins, polyamide resins, fluororesins, polycarbonate resins and polyacetal resins. The above polyolefin resins include polyethylene, the above polyacrylic resins include (meth)acrylate-based resins, and the above fluororesins include polyvinylidene fluoride.

The elastomers include diene elastomers, polyolefin elastomers (TPO), styrene-based elastomers, thermoplastic elastomers, silicone resin elastomers and fluororesin elastomers. The above diene elastomers include 1,2-polybutadiene. The above styrene-based elastomers include styrene-butadiene-styrene block copolymer (SBS) and hydrogenated block copolymers thereof (SEBS). The above thermoplastic elastomers include thermoplastic polyurethane elastomers (TPU), thermoplastic polyester elastomers (TPEE) and polyamide elastomers (TPAE).

The above rubbers include conjugated diene rubbers, nitrile rubbers, acrylic rubber, ethylene-α-olefin rubbers and others. The above conjugated diene rubbers include butadiene rubber (high-cis butadiene rubber and low-cis butadiene rubber), isoprene rubber, styrene-butadiene rubber and styrene-isoprene rubber. The above nitrile rubbers include acrylonitrile-butadiene rubber. The above ethylene-α-olefin rubbers include ethylene-propylene rubber and ethylene-propylene-non-conjugated diene rubber. The other rubbers include butyl rubber, silicone rubber and fluorine rubber.

The above cured resins include urethane resins, epoxy resins, acrylic resins, unsaturated polyester resins, polyurethane-urea resins, urea resins, silicon resins, phenolic resins and vinyl ester resins.

These organic materials may be modified by an acid anhydride group, carboxyl group, hydroxyl group, epoxy group or amino group. The affinity for the water-soluble particles to be described hereinafter and slurry can be adjusted by modification.

These organic materials may be used alone or in combination of two or more.

The organic material may be a partially or wholly crosslinked polymer or non-crosslinked polymer. That is, the water-insoluble matrix may be made of a crosslinked polymer alone, a mixture of a crosslinked polymer and a non-crosslinked polymer, or a non-crosslinked polymer alone. It is preferably made of a crosslinked polymer alone or a mixture of a crosslinked polymer and a non-crosslinked polymer. When a crosslinked polymer is contained, elastic recovery force is provided to the water-insoluble matrix and displacement caused by shear stress applied to the chemical mechanical polishing pad during polishing can be reduced. Further, it is possible to effectively prevent the pores from being filled by the plastic deformation of the water-insoluble matrix when it is excessively stretched at the time of polishing and dressing and the surface of the chemical mechanical polishing pad from being excessively fluffed. Therefore, the pores are formed efficiently even at the time of dressing, whereby the deterioration of the holding properties of the slurry during polishing can be suppressed, and further the polishing pad is rarely fluffed, thereby making it possible to realize excellent polishing flatness.

The method of crosslinking the above material is not particularly limited. For example, chemical crosslinking making use of an organic peroxide, sulfur or a sulfur compound, or radiation crosslinking by applying an electron beam may be employed.

Out of the above organic materials, a crosslinked rubber, cured resin, crosslinked thermoplastic resin or crosslinked elastomer may be used as the crosslinked polymer. A crosslinked thermoplastic resin and/or crosslinked elastomer all of which are stable to a strong acid or strong alkali contained in most of aqueous dispersions for chemical mechanical polishing and are rarely softened by water absorption are/is preferred. Out of the crosslinked thermoplastic resin and the crosslinked elastomer, what is crosslinked with an organic peroxide is more preferred, and crosslinked 1,2-polybutadiene is particularly preferred.

The amount of the crosslinked polymer is not particularly limited but preferably 30 vol % or more, more preferably 50 vol % or more, particularly preferably 70 vol % or more and may be 100 vol % of the water-insoluble matrix. When the amount of the crosslinked polymer contained in the water-insoluble matrix is 30 vol % or more, the effect obtained by containing the crosslinked polymer in the water-insoluble matrix can be fully obtained.

The above water-insoluble matrix material may contain a compatibilizing agent which differs from the above water-insoluble matrix material to control its affinity for the water-soluble particles and the dispersibility of the water-soluble particles in the water-insoluble matrix material. Examples of the compatibilizing agent include homopolymers, block copolymers and random copolymers modified by an acid anhydride group, carboxyl group, hydroxyl group, epoxy group, oxazoline group or amino group, nonionic surfactants and coupling agents.

The above water-soluble particles in the former material are particles which are eliminated from the water-insoluble matrix upon their contact with an aqueous medium contained in the aqueous dispersion for chemical mechanical polishing during chemical mechanical polishing. This elimination may occur when they dissolve upon their contact with the aqueous medium or when they swell and become colloidal by absorbing water contained in the aqueous medium. Further, this dissolution or swelling is caused not only by their contact with water but also by their contact with an aqueous mixed medium containing an alcohol-based solvent such as methanol.

The material constituting the water-soluble particles is not particularly limited. They are, for example, organic water-soluble particles or inorganic water-soluble particles. Examples of the material of the organic water-soluble particles include saccharides (polysaccharides such as starch, dextrin and cyclodextrin, lactose, mannitol), celluloses (such as hydroxypropyl cellulose, methyl cellulose), protein, polyvinyl alcohol, polyvinyl pyrrolidone, polyacrylic acid, polyethylene oxide, water-soluble photosensitive resins, sulfonated polyisoprene and sulfonated isoprene copolymers. Examples of the material of the inorganic water-soluble particles include potassium acetate, potassium nitrate, potassium carbonate, potassium hydrogencarbonate, potassium chloride, potassium bromide, potassium phosphate and magnesium nitrate. The above materials may be used alone or in combination of two or more for these water-soluble particles. The water-soluble particles may be made of one predetermined material, or two or more different materials.

The water-soluble particles contained in the former material are particularly preferably solid because they can set the hardness of the pad to an appropriate value.

The water-soluble particles have an average particle diameter of preferably 0.1 to 500 μm, more preferably 0.5 to 100 μm. The pores formed by the elimination of the water-soluble particles are as big as preferably 0.1 to 500 μm, more preferably 0.5 to 100 μm. When the average particle diameter of the water-soluble particles is within the above range, a chemical mechanical polishing pad having a high polishing rate and excellent mechanical strength can be obtained.

The amount of the water-soluble particles is preferably 1 to 90 vol %, more preferably 1 to 60 vol %, much more preferably 1 to 40 vol % based on 100 vol % of the total of the water-insoluble matrix and the water-soluble particles. When the amount of the water-soluble particles is within the above range, a chemical mechanical polishing pad having a high polishing rate, appropriate hardness and mechanical strength can be obtained.

It is preferred that the water-soluble particles should dissolve in water or swell only when they are exposed to the surface layer of the polishing pad and should not absorb moisture or swell when they are existent in the inside of the polishing pad. Therefore, the water-soluble particles may have an outer shell for suppressing moisture absorption on at least part of their outermost portion. This outer shell may be physically adsorbed to the water-soluble particle, chemically bonded to the water-soluble particle, or in contact with the water-soluble particle by physical adsorption and chemical bonding. The outer shell is made of an epoxy resin, polyimide, polyamide, polysilicate or silane coupling agent. In this case, the water-soluble particles may consist of water-soluble particles having an outer shell and water-soluble particles having no outer shell Even when surface of the water-soluble particles having an outer shell are not entirely covered with the outer shell, the above effect can be fully obtained.

The water-insoluble matrix material constituting the chemical mechanical polishing pad which comprises the latter material containing a water-insoluble matrix and voids dispersed in the water-insoluble matrix is, for example, a polyurethane, melamine resin, polyester, polysulfone or polyvinyl acetate.

The average size of the voids dispersed in the above water-insoluble matrix is preferably 0.1 to 500 μm, more preferably 0.5 to 100 μm as an average value.

The chemical mechanical polishing pad of the present invention may optionally contain abrasive grains, oxidizing agent, alkali metal hydroxide, acid, pH controller and surfactant besides the above materials. It is preferred that abrasive grains and an oxidizing agent out of these be not contained.

The Shore D hardness of the chemical mechanical polishing pad of the present invention is preferably 35 or more, more preferably 35 to 100, much more preferably 50 to 90, particularly preferably 50 to 75. When the Shore D hardness is 35 or more, pressure which can be applied to the object to be polished can be increased, and the polishing rate can be thereby improved. In addition, high polishing flatness is obtained.

The process for manufacturing the chemical mechanical polishing pad of the present invention is not particularly limited, and the method of forming a groove or grooves on the polishing surface of the chemical mechanical polishing pad are not particularly limited as well. For example, after a composition for forming a chemical mechanical polishing pad which will become a chemical mechanical polishing pad is prepared and molded into a desired rough form, a groove or grooves can be formed by cutting. Alternatively, a metal mold having a recessed portion(s) corresponding to the groove or grooves to be formed is used to mold the composition for forming a chemical mechanical polishing pad, thereby making it possible to form the groove or grooves simultaneously with the manufacture of a rough form of the chemical mechanical polishing pad. After a metal mold having a recessed portion(s) corresponding to part of the groove or grooves to be formed is used to form a rough pad form having part of a desired groove or grooves, the other part of the groove or grooves may be formed by cutting.

When the chemical mechanical polishing pad of the present invention has a groove, grooves or other recessed portion on the non-polishing surface, the groove, grooves or other recessed portion may be formed similarly as described above.

The method of obtaining the composition for forming a chemical mechanical polishing pad is not particularly limited. For example, the composition can be obtained by kneading together essential materials including a predetermined organic material by means of a kneader. A conventionally known kneader may be used, such as a roll, kneader, Banbury mixer or extruder (single-screw, multiple-screw).

The composition for forming a chemical mechanical polishing pad, which comprises water-soluble particles for obtaining a chemical mechanical polishing pad containing the water-soluble particles, can be obtained, for example, by kneading together a water-insoluble matrix, water-soluble particles and other optional additives. Preferably, they are kneaded together under heating so that they can be easily processed at the time of kneading. The water-soluble particles are preferably solid at this kneading temperature. When water-soluble particles classified by the above preferred range of average particle diameter are used and kneaded under the condition that they are solid, they can be dispersed with the above preferred average particle diameter irrespective of their compatibility with the water-insoluble matrix.

Therefore, the type of the water-soluble particles is preferably selected according to the processing temperature of the water-insoluble matrix in use.

The chemical mechanical polishing pad of the present invention may be a multi-layer pad having a support layer on the non-polishing surface of the above pad.

The above support layer is a layer formed on the rear surface to support the chemical mechanical polishing pad. Although the characteristic properties of this support layer are not particularly limited, the support layer is preferably softer than the pad body. When the pad has a soft support layer, if the pad body is thin, it is possible to prevent the pad body from rising during polishing or the surface of the polishing layer from curving, whereby polishing can be carried out stably. The hardness of the support layer is preferably 90% or less, more preferably 50 to 90%, much more preferably 50 to 80%, particularly preferably 50 to 70% of the shore D hardness of the pad body.

The support layer may be made of a porous material (foam) or a non-porous material. Although the plane shape of the support layer may be circular or polygonal, the support layer preferably has the same plane shape and size as those of the polishing pad. The thickness of the support layer is not particularly limited but preferably 0.1 to 5 mm, more preferably 0.5 to 2 mm.

Although the material of the support layer is not particularly limited, an organic material is preferably used because it can be easily molded to have a predetermined shape and predetermined properties and can provide suitable elasticity. Organic materials enumerated as the material constituting the water-insoluble matrix of the chemical mechanical polishing pad of the present invention can be used as the organic material.

The chemical mechanical polishing method of the present invention is characterized by chemically mechanically polishing the surface to be polished by using the above chemical mechanical polishing pad of the present invention. The chemical mechanical polishing method of the present invention can be carried out in accordance with a known method except that the chemical mechanical polishing pad of the present invention is set in a commercially available chemical polishing machine.

The material constituting the surface to be polished is a metal which is a wiring material, barrier metal, insulating material or a combination thereof. Examples of the above metal as the wiring material include tungsten, aluminum, copper and an alloy containing at least one of them. Examples of the above barrier metal include tantalum, tantalum nitride, niobium and niobium nitride. Examples of the above insulating material include $SiO_2$, boron phosphorus silicate (BPSG) obtained by adding small amounts of boron and phosphorus to $SiO_2$, insulating material called "FSG (Fluorine-Doped Silicate Glass)" obtained by doping $SiO_2$ with fluorine, and silicon oxide-based insulating materials having a low dielectric constant. Examples of $SiO_2$ include a thermally oxidated film, PETEOS (Plasma Enhanced-TEOS), HDP (High Density Plasma Enhanced-TEOS) and $SiO_2$ obtained by thermal CVD.

The object to be polished by the chemical mechanical polishing method of the present invention is preferably an object made of copper or copper alloy, object made of copper or a copper alloy and an insulating material, or object made of copper or a copper alloy, a barrier metal and an insulating material.

As obvious from the following examples, the chemical mechanical polishing pad and chemical mechanical polishing method of the present invention are excellent in terms of polishing rate and in-plane uniformity in the amount of polishing of the surface to be polished even when the amount of an aqueous dispersion for chemical mechanical polishing is made small. The mechanism that the above excellent performance is obtained is not made clear yet. It is assumed that this is because the aqueous dispersion is efficiently supplied to the interface between the polishing surface and the surface to be polished and the contact area between the polishing surface and the surface to be polished is ensured during chemical mechanical polishing by employing the above specific groove design.

EXAMPLES

Example 1

(1) Manufacture of Chemical Mechanical Polishing Pad 80 parts by volume (equivalent to 72 parts by mass) of 1,2-polybutadiene (manufactured by JSR Corporation, trade name of "JSR RB830") which would be crosslinked to become a water-insoluble matrix and 20 parts by volume (equivalent to 28 parts by mass) of β-cyclodextrin (manufactured by Bio Research Corporation of Yokohama, trade name of "Dexy Pearl β-100", average particle diameter of 20 μm) as water-soluble particles were kneaded together by an extruder set at 160° C. Thereafter, 0.24 part by mass of dicumyl peroxide (manufactured by NOF Corporation, trade name of "Percumyl D") was added to and kneaded with the above kneaded product at 120° C. to obtain a pellet. The resulting kneaded product was then heated in a metal mold at 170° C. for 18 minutes to be crosslinked so as to obtain a disk-like molded product having a diameter of 508 mm and a thickness of 2.8 mm. Concentrically circular grooves having a width of 0.5 mm, a pitch of 3.5 mm (land ratio of 6.0) and a depth of 2.2 mm with the center of the polishing surface of this molded product as the center thereof were formed in the polishing surface of this molded product by using a cutting machine manufactured by Kato Machine Corporate (first grooves). Out of the first grooves, the radius of the smallest circular groove was 25 mm and the radius of the largest circular groove was 252.5 mm. Further, 64 linear grooves (having a width of 3.0 mm and a depth of 2.2 mm) extending from the center portion to the peripheral end of the pad were formed in the polishing surface at an angle between adjacent linear grooves of 5.625° (second grooves). Out of the 64 linear grooves, 32 were in contact with one another at the center of the polishing surface of the pad, the other 32 started from points 25 mm away from the center of the polishing surface, and each one of the linear grooves starting from points 25 mm away from the center of the polishing surface was existent between every adjacent pair of the 32 second grooves which were in contact with one another at the center of the polishing surface of the pad.

(2) Polishing Test on PETEOS Film Without a Pattern

The above manufactured chemical mechanical polishing pad was set on the platen of the "Mirra/Mesa" polishing machine (trade name, manufactured by Applied Materials Inc.), and a wafer having a PETEOS film without a pattern (a PETEOS film ($SiO_2$ film formed from tetraethyl orthosilicate (TEOS) by chemical vapor deposition using plasma as a promoting condition) having a thickness of 10,000 Å formed on an 8-inch silicon substrate) was polished by using the "SS-25" (trade name, manufactured by CABOT Corporation) diluted 2 times with ion exchange water as an aqueous dispersion for chemical mechanical polishing under the following conditions.

Head revolution: 63 rpm

Platen revolution: 57 rpm

Head pressure: 5 psi flow rate of aqueous dispersion for chemical mechanical polishing: 100 ml/min Polishing time: 1 minute The flow rate of the aqueous dispersion for chemical mechanical polishing used in this example was about half of the standard flow rate in the polishing machine in use.

(3) Evaluation of Polishing Rate of PETEOS Film Without a Pattern 49 points spaced equally in the diameter direction of the 8-inch wafer having a PETEOS film which is the above material to be polished excluding a 5 mm portion from the periphery were determined as specified points so as to calculate the polishing rate at each point from the difference in the thickness of the PETEOS film before and after polishing and the polishing time.

The average value of the polishing rates at the 49 points was taken as the polishing rate. The results are shown in Table 1.

The thickness of the PETEOS film at each point was measured by an optical film thickness meter.

(4) Evaluation of In-plane Uniformity in the Amount of Polishing of PETEOS Film Without a Pattern In-plane uniformity in the amount of polishing was calculated from the difference in the thickness of the PETEOS film before and after polishing at the above 49 points (this value is taken as "the amount of polishing") based on the following equation.

In-plane uniformity in the amount of polishing (%)= (standard deviation of the amount of polishing÷average value of the amount of polishing)×100

The results are shown in Table 1. When this value is 5% or less, it can be said that the in-plane uniformity is satisfactory and when this value is 3% or less, it can be said that the in-plane uniformity is excellent.

Examples 2 to 12 and Comparative Examples 1 and 2

Disk-like molded products having the same composition and size as those of Example 1 were fabricated in the same manner as in Example 1 in order to manufacture chemical mechanical polishing pads having first grooves (concentrically circular grooves) and second grooves (linear grooves which extended from the center portion and reached the peripheral end of the pad) as shown in Table 1. The PETEOS film was polished in the same manner as in Example 1 to evaluate the chemical mechanical polishing pads. The results are shown in Table 1.

In Examples 2 to 8, out of the formed first grooves, the radius of the smallest circular groove was 25 mm and the radius of the largest circular groove was 252.5 mm. In Examples 9 to 12, the radius of the smallest circular groove was 25 mm and the radius of the largest circular groove was 253 mm. In Examples 2 to 12, the second grooves which were not in contact with any other second grooves started from points 25 mm away from the center of the polishing surface.

The configuration of the second grooves in Example 2 was the same as that of Example 1, the configuration of the second grooves in Example 3 was the same as that of Example 1 except that the depth of the grooves differed from that of Example 1, the angle between every adjacent pair of 32 second grooves in Example 4 to 12 was 11.25°, each one linear groove starting from a point 25 mm away from the center of the polishing surface was existent between every adjacent pair of 16 second grooves which were in contact with one another at the center of the polishing surface of the pad out of the second grooves in Example 4, 3 linear grooves starting from points 25 mm away from the center of the polishing surface were existent between every adjacent pair of 8 second grooves which were in contact with one another at the center of the polishing surface of the pad out of the second grooves in Example 5, and 7 linear grooves starting from points 25 mm away from the center of the polishing surface were existent between every adjacent pair of 4 second grooves which were in contact with one another at the center of the polishing surface of the pad out of the second grooves in Examples 6 to 12 and Comparative Example 1. The second grooves were not formed in the pad of Comparative Example 2.

TABLE 1

| | First grooves | | | | Second grooves | | | | Polishing results | |
|---|---|---|---|---|---|---|---|---|---|---|
| | Depth (mm) | Pitch (mm) | Width (mm) | Land ratio | Depth (mm) | Width (mm) | Number of grooves | Number of grooves in contact with one another | Polishing rate (nm/min) | In-plane uniformity (%) |
| Ex. 1 | 2.2 | 3.5 | 0.500 | 6.0 | 2.2 | 3.0 | 64 | 32 | 340 | 4.70 |
| Ex. 2 | 1.4 | 3.5 | 0.500 | 6.0 | 2.2 | 3.0 | 64 | 32 | 350 | 4.65 |
| Ex. 3 | 1.4 | 3.5 | 0.500 | 6.0 | 1.4 | 3.0 | 64 | 32 | 370 | 4.53 |
| Ex. 4 | 1.4 | 3.5 | 0.500 | 6.0 | 1.4 | 3.0 | 32 | 16 | 390 | 4.10 |
| Ex. 5 | 1.4 | 3.5 | 0.500 | 6.0 | 1.4 | 3.0 | 32 | 8 | 410 | 3.87 |
| Ex. 6 | 1.4 | 3.5 | 0.500 | 6.0 | 1.4 | 3.0 | 32 | 4 | 430 | 3.01 |
| Ex. 7 | 1.4 | 3.5 | 0.500 | 6.0 | 1.4 | 2.0 | 32 | 4 | 450 | 2.84 |
| Ex. 8 | 1.4 | 3.5 | 0.500 | 6.0 | 1.4 | 0.5 | 32 | 4 | 510 | 2.61 |
| Ex. 9 | 1.4 | 4.0 | 0.500 | 7.0 | 1.4 | 0.5 | 32 | 4 | 540 | 2.31 |
| Ex. 10 | 1.4 | 4.0 | 0.375 | 9.7 | 1.4 | 0.5 | 32 | 4 | 550 | 1.89 |
| Ex. 11 | 1.4 | 4.0 | 0.350 | 10.4 | 1.4 | 0.5 | 32 | 4 | 580 | 1.00 |
| Ex. 12 | 1.4 | 4.0 | 0.250 | 15.0 | 1.4 | 0.5 | 32 | 4 | 600 | 0.94 |
| C. Ex. 1 | 1.4 | 2.0 | 0.500 | 3.0 | 1.4 | 0.5 | 32 | 4 | 320 | 7.30 |
| C. Ex. 2 | 1.4 | 3.5 | 0.500 | 6.0 | None | None | None | None | 270 | 10.5 |

Ex.: Example
C. Ex.: Comparative Example

Example 13

(1) Polishing Test on Copper (Cu) Film Without a Pattern

A chemical mechanical polishing pad manufactured in the same manner as in Example 1 was set on the platen of the "Mirra/Mesa" polishing machine (of Applied Materials Inc.) to polish a wafer having a copper film without a pattern (a copper film having a thickness of 15,000 Å on an 8-inch silicon substrate having a thermally oxidated film) under the following conditions.

Head revolution: 103 rpm
Platen revolution: 97 rpm
Head pressure: 3 psi
flow rate of aqueous dispersion for chemical mechanical polishing: 100 ml/min
Polishing time: 1 minute An aqueous dispersion for chemical mechanical polishing having a pH of 2.5 and containing 1.0 mass % of silica, 0.5 mass % of malic acid, 7.0 mass % of hydrogen peroxide (concentration of 30 mass %) and 0.2 masse of benzotriazole was used. The flow rate of the aqueous dispersion for chemical mechanical polishing used in this example was about half of the standard flow rate in the polishing machine in use.

(2) Evaluation of Polishing Rate of Copper Film Without a Pattern 49 points equally in the diameter direction of the 8-inch wafer having a copper film which is the above material to be polished excluding a 5 mm portion from the periphery were determined as specified points so as to calculate the polishing rate at each point from the difference in the thickness of the copper film before and after polishing and the polishing time.

The average value of the polishing rates at the 49 points was taken as the polishing rate. The results are shown in Table 2.

The thickness of the copper film at each point was measured by "Omnimap RS75" electroconductive film thickness meter (of KLA-Tencor Corporation).

(3) Evaluation of In-plane Uniformity in the Amount of Polishing of Copper Film Without a Pattern The in-plane uniformity was calculated from the difference in the thickness of the Cu film before and after polishing at the above 49 points (this value is taken as "the amount of polishing") based on the following equation.

In-plane uniformity in the amount of polishing (%)= (standard deviation of the amount of polishing÷average value of the amount of polishing)×100

The results are shown in Table 2. When this value is 5% or less, it can be said that the in-plane uniformity is satisfactory and when this value is 3% or less, it can be said that the in-plane uniformity is excellent.

Examples 14 to 24 and Comparative Examples 3 and 4

A polishing test was made on a copper film without a pattern in the same manner as in Example 13 except that chemical mechanical polishing pads manufactured in the same manner as in Examples 2 to 13 and Comparative Examples 1 and 2 were used to evaluate the polishing rate and the in-plane uniformity in the amount of polishing. The evaluation results are shown in Table 2.

TABLE 2

| | First grooves | | | | Second grooves | | | | Polishing results | |
|---|---|---|---|---|---|---|---|---|---|---|
| | Depth (mm) | Pitch (mm) | Width (mm) | Land ratio | Depth (mm) | Width (mm) | Number of grooves | Number of grooves in contact with one another | Polishing rate (nm/min) | In-plane uniformity (%) |
| Ex. 13 | 2.2 | 3.5 | 0.500 | 6.0 | 2.2 | 3.0 | 64 | 32 | 550 | 4.80 |
| Ex. 14 | 1.4 | 3.5 | 0.500 | 6.0 | 2.2 | 3.0 | 64 | 32 | 560 | 4.75 |
| Ex. 15 | 1.4 | 3.5 | 0.500 | 6.0 | 1.4 | 3.0 | 64 | 32 | 590 | 4.57 |
| Ex. 16 | 1.4 | 3.5 | 0.500 | 6.0 | 1.4 | 3.0 | 32 | 16 | 600 | 4.00 |
| Ex. 17 | 1.4 | 3.5 | 0.500 | 6.0 | 1.4 | 3.0 | 32 | 8 | 620 | 3.50 |
| Ex. 18 | 1.4 | 3.5 | 0.500 | 6.0 | 1.4 | 3.0 | 32 | 4 | 650 | 2.68 |
| Ex. 19 | 1.4 | 3.5 | 0.500 | 6.0 | 1.4 | 2.0 | 32 | 4 | 690 | 2.01 |
| Ex. 20 | 1.4 | 3.5 | 0.500 | 6.0 | 1.4 | 0.5 | 32 | 4 | 720 | 1.97 |
| Ex. 21 | 1.4 | 4.0 | 0.500 | 7.0 | 1.4 | 0.5 | 32 | 4 | 750 | 1.65 |
| Ex. 22 | 1.4 | 4.0 | 0.375 | 9.7 | 1.4 | 0.5 | 32 | 4 | 760 | 1.55 |
| Ex. 23 | 1.4 | 4.0 | 0.350 | 10.4 | 1.4 | 0.5 | 32 | 4 | 800 | 1.10 |
| Ex. 24 | 1.4 | 4.0 | 0.250 | 15.0 | 1.4 | 0.5 | 32 | 4 | 830 | 0.65 |
| C. Ex. 3 | 1.4 | 2.0 | 0.500 | 3.0 | 1.4 | 0.5 | 32 | 4 | 500 | 8.60 |
| C. Ex. 4 | 1.4 | 3.5 | 0.500 | 6.0 | None | None | None | None | 480 | 11.3 |

Ex.: Example
C. Ex.: Comparative Example

Example 25

(1) Manufacture of Chemical Mechanical Polishing Pad 95 parts by volume (equivalent to 92.5 parts by mass) of a mixture obtained by dry blending together 30 parts by mass of polystyrene (manufactured by PS Japan Corporation, trade name of "HF55") and 70 parts by mass of 1,2-polybutadiene (manufactured by JSR Corporation, trade name of "JSR RB830") and 5 parts by volume (equivalent to 7.5 parts by mass) of β-cyclodextrin (manufactured by Bio Research Corporation of Yokohama, trade name of "Dexy Pearl β-100") were kneaded together at 150° C. and 120 rpm by an extruder heated at 120° C. Thereafter, 0.12 part by mass (equivalent to 0.03 part by mass in terms of pure dicumyl peroxide) of "Percumyl D40" (trade name, manufactured by NOF Corporation, containing 40 mass % of dicumyl peroxide) was added to and kneaded with the above kneaded product at 120° C. and 60 rpm. The resulting kneaded product was then heated in a metal mold at 175° C. for 12 minutes to be crosslinked so as to obtain a disk-like molded product having a diameter of 508 mm and a thickness of 2.8 mm. The same grooves as in Example 7 were formed in the polishing surface of this molded product to manufacture a chemical mechanical polishing pad.

(2) Polishing Test on PETEOS Film Without a Pattern

A polishing test was made on a PETEOS film without a pattern in the same manner as in Example 1 except that the above manufactured polishing pad was used to evaluate the polishing rate and the in-plane uniformity in the amount of polishing. The results are shown in Table 3.

Examples 26 to 28 and Comparative Examples 5 and 6

Disk-like molded products having the same composition and size as those of Example 25 were fabricated in the same manner as in Example 25 and the same grooves as in Example 8, 9 and 12 were formed to manufacture chemical mechanical polishing pads, and the PETEOS film was polished in the same manner as in Example 1 to evaluate the manufactured chemical mechanical polishing pads. The results are shown in Table 3.

TABLE 3

| | First grooves | | | | Second grooves | | | | Polishing results | |
|---|---|---|---|---|---|---|---|---|---|---|
| | Depth (mm) | Pitch (mm) | Width (mm) | Land ratio | Depth (mm) | Width (mm) | Number of grooves | Number of grooves in contact with one another | Polishing rate (nm/min) | In-plane uniformity (%) |
| Ex. 25 | 1.4 | 3.5 | 0.500 | 6.0 | 1.4 | 2.0 | 32 | 4 | 450 | 2.89 |
| Ex. 26 | 1.4 | 3.5 | 0.500 | 6.0 | 1.4 | 0.5 | 32 | 4 | 480 | 1.50 |
| Ex. 27 | 1.4 | 4.0 | 0.500 | 7.0 | 1.4 | 0.5 | 32 | 4 | 530 | 1.20 |
| Ex. 28 | 1.4 | 4.0 | 0.250 | 15.0 | 1.4 | 0.5 | 32 | 4 | 570 | 0.87 |

TABLE 3-continued

| | First grooves | | | | Second grooves | | | | Polishing results | |
|---|---|---|---|---|---|---|---|---|---|---|
| | Depth (mm) | Pitch (mm) | Width (mm) | Land ratio | Depth (mm) | Width (mm) | Number of grooves | Number of grooves in contact with one another | Polishing rate (nm/min) | In-plane uniformity (%) |
| C. Ex. 5 | 1.4 | 2.0 | 0.500 | 3.0 | 1.4 | 0.5 | 32 | 4 | 350 | 6.70 |
| C. Ex. 6 | 1.4 | 3.5 | 0.500 | 6.0 | None | None | None | None | 300 | 8.90 |

Ex.: Example
C. Ex.: Comparative Example

Example 29

(1) Manufacture of Chemical Mechanical Polishing Pad 98 parts by volume (equivalent to 97 parts by mass) of 1,2-polybutadiene (manufactured by JSR Corporation, trade name of "JSR RB830") which would be crosslinked to become a water-insoluble matrix and 2 parts by volume (equivalent to 3 parts by mass) of β-cyclodextrin (manufactured by Bio Research Corporation of Yokohama, trade name of "Dexy Pearl β-100", average particle diameter of 20 μm) as water-soluble particles were kneaded together by an extruder set at 120° C. Thereafter, 0.37 part by mass of dicumyl peroxide (manufactured by NOF Corporation, trade name of "Percumyl D") was added to and kneaded with the above kneaded product at 120° C. to obtain a pellet. The resulting kneaded product was then heated in a metal mold at 175° C. for 12 minutes to be crosslinked so as to obtain a disk-like molded product having a diameter of 508 mm and a thickness of 2.8 mm. The same grooves as in Example 7 were formed in the polishing surface of this molded product to manufacture a chemical mechanical polishing pad.

(2) Polishing Test on PETEOS Film Without a Pattern

A polishing test was made on a PETEOS film without a pattern in the same manner as in Example 1 except that the above manufactured polishing pad was used to evaluate the polishing rate and the in-plane uniformity in the amount of polishing. The results are shown in Table 4.

Examples 30 to 32 and Comparative Examples 7 and 8

Disk-like molded products having the same composition and size as those of Example 29 were fabricated in the same manner as in Example 29 and the same grooves as in Example 8, 9 and 12 were formed to manufacture chemical mechanical polishing pads, and the PETEOS film was polished in the same manner as in Example 1 to evaluate the manufactured chemical mechanical polishing pads. The results are shown in Table 4.

TABLE 4

| | First grooves | | | | Second grooves | | | | Polishing results | |
|---|---|---|---|---|---|---|---|---|---|---|
| | Depth (mm) | Pitch (mm) | Width (mm) | Land ratio | Depth (mm) | Width (mm) | Number of grooves | Number of grooves in contact with one another | Polishing rate (nm/min) | In-plane uniformity (%) |
| Ex. 29 | 1.4 | 3.5 | 0.500 | 6.0 | 1.4 | 2.0 | 32 | 4 | 370 | 2.50 |
| Ex. 30 | 1.4 | 3.5 | 0.500 | 6.0 | 1.4 | 0.5 | 32 | 4 | 430 | 1.35 |
| Ex. 31 | 1.4 | 4.0 | 0.500 | 7.0 | 1.4 | 0.5 | 32 | 4 | 480 | 1.10 |
| Ex. 32 | 1.4 | 4.0 | 0.250 | 15.0 | 1.4 | 0.5 | 32 | 4 | 530 | 0.98 |
| C. Ex. 7 | 1.4 | 2.0 | 0.500 | 3.0 | 1.4 | 0.5 | 32 | 4 | 320 | 6.40 |
| C. Ex. 8 | 1.4 | 3.5 | 0.500 | 6.0 | None | None | None | None | 270 | 8.70 |

Ex.: Example
C. Ex.: Comparative Example

Example 33

(1) Manufacture of Chemical Mechanical Polishing Pad 58 parts by mass of 4,4'-diphenylmethane diisocyanate (manufactured by Sumika Bayer Urethane Co., Ltd., trade name of "Sumidule 44S") was fed to a reactor, and 5.1 parts by mass of polytetramethylene glycol having two hydroxyl groups at both terminals of the molecule and a number average molecular weight of 650 (manufactured by Mitsubishi Chemical Corporation, trade name of "PTMG650") and 17.3 parts by mass of polytetramethylene glycol having a number average molecular weight of 250 (manufactured by Mitsubishi Chemical Corporation, trade name of "PTMG250") were added to the reactor at 60° C. under agitation, maintained at 90° C. for 2 hours under agitation to carry out a reaction, and then cooled to obtain an isocyanate terminated prepolymer. This isocyanate terminated prepolymer was a mixture of 21 masse of unreacted 4,4'-diphenylmethane diisocyanate and 79 masse of a prepolymer having an isocyanate group at both terminals.

80.4 parts by mass of the above isocyanate terminated prepolymer was fed to a stirring container and maintained at 90° C., 14.5 parts by mass of β-cyclodextrin (manufactured by Bio Research Corporation of Yokohama, trade name of "Dexy Pearl β-100") was added under agitation at 200 rpm to be mixed and dispersed in the above prepolymer for 1 hour, and the obtained dispersion was vacuum defoamed to obtain an isocyanate terminated prepolymer containing water-soluble particles dispersed therein.

12.6 parts by mass of 1,4-bis(β-hydroxyethoxy)benzene having two hydroxyl groups at a terminal (manufactured by Mitsui Fine Chemicals Inc., trade name of "BHEB") was heated at 120° C. for 2 hours in a stirring container to be molten, and 7 parts by mass of trimethylolpropane having three hydroxyl groups (manufactured by BASF Japan Ltd., trade name of TMP) was added under agitation to be mixed and dissolved in the above molten product for 10 minutes so as to obtain a chain extender mixture.

94.9 parts by mass of the obtained isocyanate terminated prepolymer containing water-soluble particles dispersed therein was heated at 90° C. and stirred in an AJITER (registered trademark) mixer, and 19.6 parts by mass of the obtained chain extender mixture heated at 120° C. was added to and mixed with the prepolymer for 1 minute to obtain a raw material mixture.

The above raw material mixture was injected into a metal mold with a disk-like cavity having a diameter of 508 mm and a thickness of 2.8 mm to an extent that the cavity was filled and maintained at 110° C. for 30 minutes to carry out a polyurethanation reaction, and then the mold was removed. Further, the molded product was post-cured in a gear oven at 110° C. for 16 hours to obtain a polyurethane sheet having a diameter of 508 mm and a thickness of 2.8 mm and containing water-soluble particles dispersed therein. The volume fraction of the water-soluble particles to the entire sheet, that is, the volume fraction of the water-soluble particles to the total of the polyurethane matrix and the water-soluble particles was 10%.

The same grooves as in Example 7 were formed in the entire polishing surface of the molded sheet excluding a 30 mm center portion by using a cutting machine to manufacture a chemical mechanical polishing pad.

(2) Polishing Test on PEETOS Film Without a Pattern

A polishing test was made on a PETEOS film without a pattern in the same manner as in Example 1 except that the above manufactured polishing pad was used to evaluate the polishing rate and the in-plane uniformity in the amount of polishing. The results are shown in Table 5.

Examples 34 to 36 and Comparative Examples 9 and 10

Disk-like molded products having the same composition and size as those of Example 33 were fabricated in the same manner as in Example 33 and the same grooves as in Example 8, 9 and 12 were formed to manufacture chemical mechanical polishing pads, and the PETEOS film was polished in the same manner as in Example 1 to evaluate the manufactured chemical mechanical polishing pads. The results are shown in Table 5.

TABLE 5

| | First grooves | | | | Second grooves | | | | Polishing results | |
|---|---|---|---|---|---|---|---|---|---|---|
| | Depth (mm) | Pitch (mm) | Width (mm) | Land ratio | Depth (mm) | Width (mm) | Number of grooves | Number of grooves in contact with one another | Polishing rate (nm/min) | In-plane uniformity (%) |
| Ex. 33 | 1.4 | 3.5 | 0.500 | 6.0 | 1.4 | 2.0 | 32 | 4 | 350 | 2.30 |
| Ex. 34 | 1.4 | 3.5 | 0.500 | 6.0 | 1.4 | 0.5 | 32 | 4 | 370 | 1.90 |
| Ex. 35 | 1.4 | 4.0 | 0.500 | 7.0 | 1.4 | 0.5 | 32 | 4 | 390 | 1.75 |
| Ex. 36 | 1.4 | 4.0 | 0.250 | 15.0 | 1.4 | 0.5 | 32 | 4 | 420 | 1.20 |
| C. Ex. 9 | 1.4 | 2.0 | 0.500 | 3.0 | 1.4 | 0.5 | 32 | 4 | 300 | 6.80 |
| C. Ex. 10 | 1.4 | 3.5 | 0.500 | 6.0 | None | None | None | None | 260 | 9.20 |

Ex.: Example
C. Ex.: Comparative Example

As obvious from the results of the above Examples and Comparative Examples, the chemical mechanical polishing pad of the present invention having first grooves with a land ratio of 6 to 30 and second grooves consisting of second grooves which are not in contact with any other second grooves in the area of the center portion and second grooves which are in contact with one another in the area of the center portion in the polishing surface can achieve a high polishing rate and excellent in-plane uniformity in the amount of polishing even when the flow rate of an aqueous dispersion for chemical mechanical polishing is small.

What is claimed is:

1. A chemical mechanical polishing pad comprising a polishing surface and a non-polishing surface on a side opposite the polishing surface, wherein the polishing surface comprises at least two groups of grooves:

(i) a group of first grooves that intersect a single virtual straight line extending from the center toward the periphery of the polishing surface, do not intersect one another and have a land ratio represented by the following equation (1) of 6 to 30:

$$\text{Land ratio}=(P-W)\div W \quad (1)$$

wherein P is the distance between adjacent intersections between the virtual straight line and the first grooves, and W is the width of the first, grooves; and (ii) a group of second grooves that extend from the center portion toward the peripheral portion of the polishing surface, intersect the first grooves, consist of second grooves which are in contact with one another in the area of the center portion and second grooves which are not in contact with any other second grooves in the area of the center portion, and do not intersect one another.

2. The chemical mechanical polishing pad according to claim 1, wherein the distance P between adjacent intersections between the virtual straight line and the first grooves is 3.8 mm or more.

3. The chemical mechanical polishing pad according to claim 1, wherein the width W of the first grooves is 0.375 mm or less.

4. A chemical mechanical polishing method for chemically mechanically polishing an object to be polished comprising contacting the object with the chemical mechanical polishing pad according to claim 1.

5. The chemical mechanical polishing method according to claim 4, whereby polishing is accomplished at a polishing rate of at least 340 nm/min.

6. The chemical mechanical polishing method according to claim 5, whereby polishing is accomplished at a polishing rate ranging from 340 to 830 nm/min.

7. The chemical mechanical polishing method according to claim 4, whereby the chemical mechanical polishing pad imparts the object with an in-plane uniformity of less than 5%.

8. The chemical mechanical polishing method according to claim 7, whereby the chemical mechanical polishing pad imparts the object with an in-plane uniformity of less than 3%.

9. The chemical mechanical polishing method according to claim 4, wherein said contacting is carried out in the presence of an aqueous dispersion having an aqueous dispersion flow rate of 100 ml/min.

10. The chemical mechanical polishing pad according to claim 1, wherein the group of first grooves have a land ratio of 6 to 20.

11. The chemical mechanical polishing pad according to claim 1, wherein the group of first grooves have a land ratio of 6 to 15.

12. A chemical mechanical polishing pad comprising a polishing surface and a non-polishing surface on a side opposite the polishing surface, wherein the polishing surface comprises one first groove and a group of second grooves:

(i) the first groove is one spiral groove which expands gradually from the center portion toward the peripheral portion of the polishing surface and has a land ratio represented by the following equation (2) of 6 to 30:

$$\text{Land ratio}=(P'-W')\div W' \quad (2)$$

wherein P' is the distance between adjacent intersections between a single virtual straight line extending from the center toward the periphery of the polishing surface and the first groove, and W' is the width of the first) groove; and (ii) the group of second grooves that extend from the center portion toward the peripheral portion of the polishing surface, intersect the first groove, consist of second grooves which are in contact with one another in the area of the center portion and second grooves which are not in contact with any other second grooves in the area of the center portion, and do not intersect one another.

13. The chemical mechanical polishing pad according to claim 12, wherein the distance P' between adjacent intersections between the virtual straight line and the first groove is 3.8 mm or more.

14. The chemical mechanical polishing pad according to claim 12, wherein the width W' of the first groove is 0.375 mm or less.

15. A chemical mechanical polishing method for chemically mechanically polishing an object to be polished comprising contacting the object with the chemical mechanical polishing pad according to claim 12.

16. The chemical mechanical polishing method according to claim 15, whereby polishing is accomplished at a polishing rate of at least 340 nm/min.

17. A chemical mechanical polishing method for chemically mechanically polishing an object to be polishing comprising:

providing a chemical mechanical polishing pad having comprising a polishing surface and a non-polishing surface on a side opposite the polishing surface, wherein the polishing surface comprises at least two groups of grooves: (i) a group of first grooves that intersect a single virtual straight line extending from the center toward the periphery of the polishing surface, do not intersect one another and have a land ratio represented by the following equation of 6 to 30: Land ratio =(P-W) ×W, wherein P is the distance between adjacent intersections between the virtual straight line and the first grooves, and W is the width of the first grooves; and (ii) a group of second grooves that extend from the center portion toward the peripheral portion of the polishing surface, intersect the first grooves, consist of second grooves which are in contact with one another in the area of the center portion and second grooves which are not in contact with any other second grooves in the area of the center portion, and do not intersect one another;

contacting the object with the chemical mechanical polishing pad.

18. The chemical mechanical polishing method according to claim 15, whereby the chemical mechanical polishing pad imparts the object with an in-plane uniformity of less than 5%.

19. The chemical mechanical polishing method according to claim 18, whereby the chemical mechanical polishing pad imparts the object with an in-plane uniformity of less than 3%.

20. The chemical mechanical polishing method according to claim 15, wherein said contacting is carried out in the presence of an aqueous dispersion having an aqueous dispersion flow rate of 100 ml/min.

21. The chemical mechanical polishing pad according to claim 12, wherein the first groove has a land ratio of 6 to 20.

22. The chemical mechanical polishing pad according to claim 12, wherein the first groove has a land ratio of 6 to 15.

* * * * *